United States Patent [19]

Norton

[11] Patent Number: 4,624,274

[45] Date of Patent: Nov. 25, 1986

[54] POOL CLEANER SWIVEL APPARATUS

[76] Inventor: Rickie E. Norton, 1421 E. Garnet, Mesa, Ariz. 85204

[21] Appl. No.: 747,896

[22] Filed: Jun. 24, 1985

[51] Int. Cl.[4] ..... B08B 3/02

[52] U.S. Cl. ..... 134/111; 134/167 R

[58] Field of Search ..... 134/111, 166 R, 167 R, 134/168 R, 171, 172, 201; 4/490; 15/1.7; 210/169

[56] References Cited

U.S. PATENT DOCUMENTS

| | | | |
|---|---|---|---|
| 3,416,176 | 12/1968 | Ravitts | 15/1.7 |
| 3,758,276 | 9/1973 | Bond et al. | 15/1.7 X |
| 4,039,351 | 8/1977 | Butler | 134/167 R X |
| 4,449,260 | 5/1984 | Whitaker | 134/168 R X |
| 4,503,874 | 3/1985 | Norton | 4/490 X |

*Primary Examiner*—Philip R. Coe
*Attorney, Agent, or Firm*—H. Gordon Shields

[57] ABSTRACT

Pool cleaner swivel apparatus for above the ground swimming pools includes a generally hollow, toroidal shaped housing with a flotation cap comprising the top of the housing and side and bottom openings through which a swimming pool cleaner vacuum hose extends. A water chamber is connected to a water source, and a swivel plate, disposed at the bottom of the housing and the chamber, moves relative to the housing. The swivel plate is connected to a swimming pool cleaner water supply hose, and the swiveling of the plate allows the swimming pool cleaner to move in the swimming pool relatively unobstructed and without getting entangled in the various hoses.

6 Claims, 4 Drawing Figures

POOL CLEANER SWIVEL APPARATUS

BACKGROUND OF THE INVENTION.

1. Field of the Invention

This invention relates to swimming pool cleaning systems and, more particularly, to swimming pool cleaning systems adapted to be used for above the ground swimming pools.

2. Description of the Prior Art

The apparatus of the present invention is designed primarily to be used in above-ground swimming pools and with swimming pool cleaning heads and cleaning systems such as disclosed in U.S. Pat. No. 4,503,874, dated Mar. 12, 1985, the inventor of which is the same as the inventor of the apparatus disclosed and claimed herein.

Since above-ground swimming pools generally do not have underground plumbing connections, the supply water and the exhaust or vacuum water drawn from the swimming pool must both be provided with hoses that extend downwardly into the pool from above. A vacuum hose, which draws water from the pool to be filtered and recirculated, generally extends to the bottom of the pool, and is preferably centrally located with respect to the pool. The vacuum hose is connected to a housing at the bottom of the pool. Any floating cleaning head apparatus, such as disclosed in the above referred-to '874 patent, must circumnavigate the vacuum hose or the cleaning apparatus will become entangled therewith. In addition, a supply hose which supplies recirculated or fresh water to the cleaning system must also circumnavigate the vacuum hose or become entangled therewith. A swivel system, such as disclosed and claimed herein, allows both the supply hose and the cleaner system hose to freely circumnavigate the vacuum hose. The alternative is, of course, to provide a separate cleaning system manually usable rather than automatic and self-regulating or moving throughout the pool. In the case of manual cleaning apparatus, such a system is obviously time consuming and cumbersome and is a substantial burden to the owner of the swimming pool.

The apparatus of the present invention provides a swivel system usable with a "fixed" vacuum hose and with an automatic swimming pool cleaning head which allows the cleaning head to circumnavigate the vacuum hose without becoming entangled therewith.

SUMMARY OF THE INVENTION

The apparatus described and claimed herein comprises swivel apparatus for a swimming pool cleaning system to enable the pool cleaning system to circumnavigate a fixed vacuum hose in the swimming pool. The swivel apparatus includes a fixed housing disposed about the fixed hose, and a swivel plate secured to the housing and rotatable therein. The movable or rotatable swivel plate is secured to the swimming pool cleaning system and moves therewith about the fixed hose.

Among the objects of the present invention are the following:

To provide new and useful swimming pool cleaning apparatus;

To provide new and useful apparatus for cleaning an aboveground swimming pool;

To provide new and useful swivel apparatus for a floating cleaning head in a swimming pool;

To provide new and useful swivel apparatus for swiveling a hose relative to a fixed hose in a swimming pool; and To provide new and useful swivel apparatus for a movable swimming pool cleaning head assembly to allow the swimming pool cleaning assembly to move freely relative to a fixed hose in the swimming pool.

DESCRIPTION OF THE PREFERRED EMBODIMENT

Figures 1, 2, 3, 4:
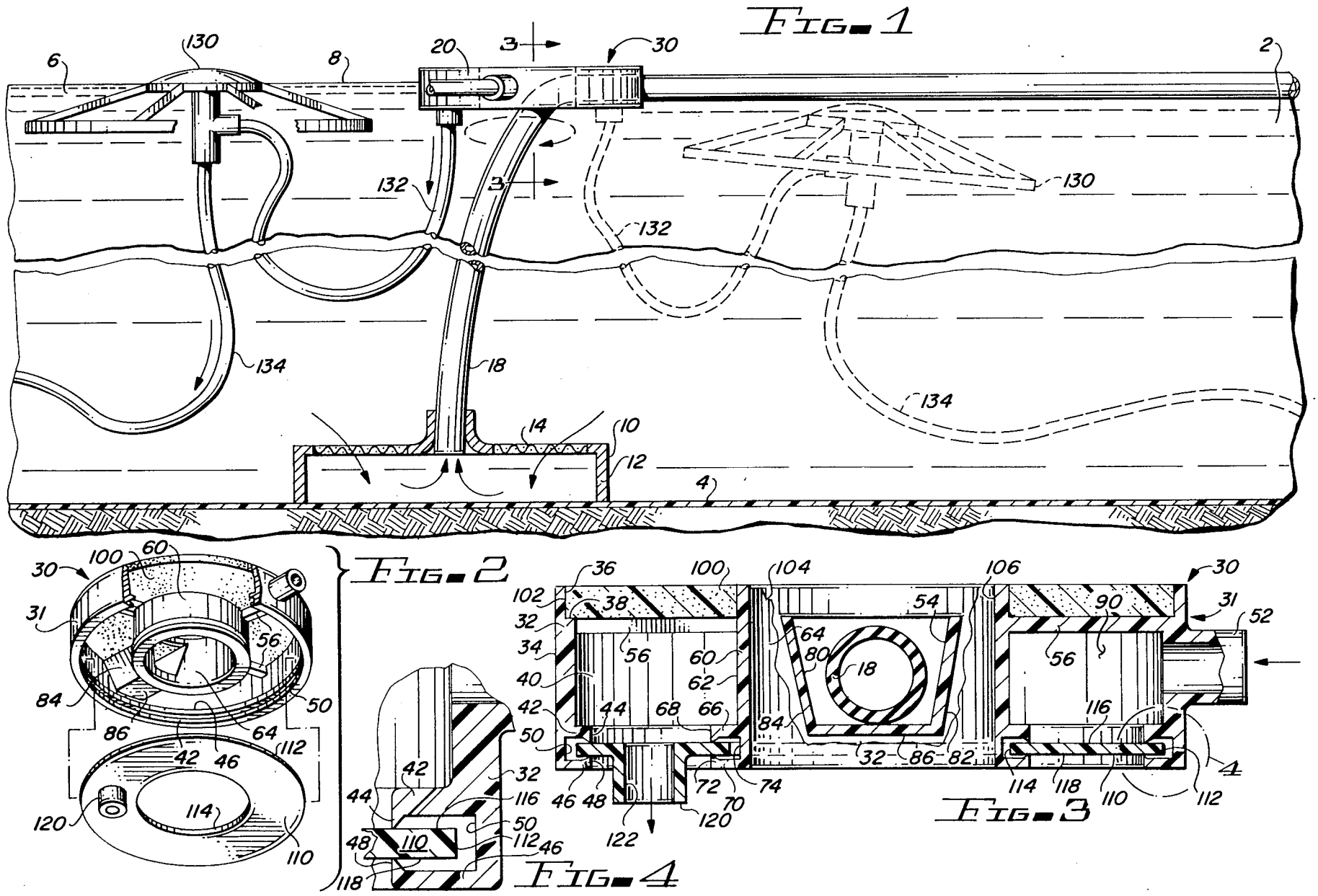
FIG. 1 is a side view of the apparatus of the present invention in its use environment.
FIG. 2 is an exploded perspective view, partially broken away, of the apparatus of the present invention.
FIG. 3 is a side view in partial section taken generally along line 3—3 of FIG. 1.
FIG. 4 is an enlarged view in partial section of a portion of the apparatus of FIG. 3, taken generally from circle 4 of FIG. 3.

FIG. 1 is a side view of a portion of an above-ground swimming pool 2. The pool 2 includes a bottom 4 and the pool is filled with water 6. The water 6 extends from the bottom 4 upwardly to a top surface 8. A water inlet vacuum housing 10 is disposed on the bottom 4. A water vacuum hose 18 floats at the top surface 8 of the water 6 and extends downwardly from the top surface 8 to the water inlet vacuum housing 10.

The water inlet vacuum housing 10 is generally circular in configuration. It accordingly includes a circular wall 12 which comprises a relatively short cylinder. Extending across the top of the cylindrical wall 12 is a screened inlet 14. A water vacuum hose connection 16 extends upwardly from the top screened inlet 14 and is connected to the water vacuum hose 18.

As indicated by the arrows in FIG. 1, water flows into the housing 10 through the screened inlet 14 and into the water vacuum hose 18. The water vacuum hose 18 extends out of the swimming pool to an appropriate filter system (not shown) for filtering the water 6 in the pool 2. The term "vacuum" simply refers to the fact that the hose 18 is connected to a pump which draws water from the pool 2. The hose 18 simply comprises a conduit for water flowing from the pool 2 to a filter (not shown).

Floating on the top surface 8 of the water 6 in the pool 2, and disposed generally above the vacuum housing 10, and disposed about the hose 18 where the hose 18 extends downwardly from the top surface 8 of the water, is swivel apparatus 30 of the present invention. The swivel apparatus 30 is shown in FIG. 1 in its use environment, disposed about a portion of the vacuum hose 18, and connected to a water supply hose 20 and to a floating pool cleaner head 130 by a hose 132.

The water supply hose 20 comprises a return line from a filter, as discussed above, which filters the water flowing through the vacuum hose 18 and returns it through the hose or conduit 20 to the swimming pool 2, as is well known and understood. The supply hose 20 also floats on the top 8 of the water 6.

In FIG. 2, the swivel apparatus 30 is shown in an exploded, perspective drawing, with a portion of the apparatus broken away for illustrative purposes. In FIG. 3, the swivel apparatus 30 is shown in partial section. FIG. 3 is generally taken along line 3—3 of FIG. 1. Details of the swivel apparatus 30 are shown in FIG. 4, which comprises an enlarged view in partial section of a portion of the swivel apparatus 30, taken generally from circle 4 of FIG. 3. For the following discussion, reference will primarily be made to FIGS. 1, 2, and 3. Specific reference will be made to FIG. 4.

The swivel apparatus 30 includes a housing 31 which includes two separate but connected housings, an outer housing 32 and an inner housing 60. The outer housing 32 includes a generally circular or cylindrical outer wall which is preferably made of polyvinylchloride (PVC) or similar material. The cylindrical outer wall or housing 32 includes an outer peripheral surface or outer periphery 34, and an inner peripheral surface or inner periphery which is divided into three separate portions. The three portions include a top inner periphery 36, a central inner periphery 40, and a bottom inner periphery 50.

The top inner periphery 36 extends downwardly a relatively short distance from the top of the wall or housing 32. A shoulder 38 extends between the lower portion of the top inner periphery 36 and the central inner periphery 40. The shoulder 38 is radially extending, and it defines an inner lip on which is disposed a floatation cap or ring 100. The diameter of the top inner periphery 36 is slightly greater than that of the central inner periphery 40, and the difference between the two diameters is the overall length or extent of the shoulder 38.

At the bottom or lower portion of the central inner periphery 40 is a radially inwardly extending flange 42. A rim 44 extends downwardly rom the inner periphery of the flange 42. This is best shown in FIG. 4. The rim 44 terminates in a relatively narrow, almost knife-like edge which is used to help support a bottom ring or plate 110. The bottom ring or plate 110 will be described in detail below.

Generally parallel to the flange 42, and spaced apart downwardly therefrom, is another radially inwardly extending flange 46. At the inner periphery of the flange 46 is an upwardly extending rim 48. The rim 48 also terminates in a relatively narrow, almost knife-like edge. The rims 44 and 48 are generally parallel to each other. The bottom inner periphery 50 is between the two flanges 42 and 46. The ring 110 is disposed between and is supported by the two rims 44 and 48, and the ring 110 bears against the two rims as it swivels or rotates. The rims 44 and 48 are, of course, circular in extent, as are their respective flanges 42 and 46.

Extending outwardly from the outer wall or housing 32 is an intake nozzle 52. The water supply hose 20 is appropriately secured to the nozzle 52. The water flowing through the hose 20 accordingly flows through the nozzle 52 and into the housing 32.

A notch 54 extends through the wall 32 of the swivel apparatus 30. The notch 54 is generally of a "U" shaped configuration, with the arms extending outwardly slightly. The water vacuum hose 18 extends through the notch 54.

Centrally located, substantially coaxially with the outer housing or wall 32, is an inner housing or wall 60. The inner housing or wall 60 is generally cylindrical in configuration, as is the outer housing or wall 32. However, the diameter of the inner housing or wall 60 is substantially less than that of the outer housing or wall 32. A water inlet chamber 90 is defined between the outer housing 32 and the inner housing 60.

The inner housing 60 includes an outer periphery or outer peripheral surface 62, and an inner periphery or inner peripheral surface 64. The inner periphery 64 comprises a vertical bore through which the vacuum hose 18 extends.

Extending radially outwardly from the outer periphery 62 of the inner wall 60 is a flange 66. The flange 66 is generally parallel to and aligned with the flange 42. A rim 68 extends downwardly from the outer periphery of the flange 66. The rim 68 is generally parallel to, or concentric with, the rim 44 of the flange 42. The rim 68 terminates downwardly in a relatively thin, knife-like edge, as does the rim 44.

Extending radially outwardly from the bottom of the wall 60 is another flange 70. The flange 70 is generally parallel to and aligned with the flange 46. A rim 72 extends upwardly from the outer periphery of the flange 72. The rim 72 terminates in a relatively thin, knife-like edge which is appropriately aligned with the edge of the rim 68. The flanges and rims which extend radially inwardly and radially outwardly, respectively, from the housings 32 and 60 are generally concentric with each other and are appropriately aligned to provide the four support surfaces, namely the edges of the rims, for supporting the bottom ring or plate 110. The ring 110 is disposed adjacent to and between the concentric paired flanges 42, 66 and 46, 70, and is supported on the rims of the flanges.

An outer periphery or outer peripheral surface 74 is defined between the flanges 66 and 70. The peripheral surface 74 is generally parallel to and concentric with, the bottom peripheral surface 50 of the housing 32.

A notch 80 extends through the wall 60. The notch 80 is generally parallel to, or radially aligned with, the notch 54 of the outer housing 32. The notch 80 is of substantially the same configuration as the notch 54, namely a generally "U" shaped notch with outwardly extending arms. The vacuum hose 18 also extends through the notch 80, and then the hose 18 extends downwardly, in a nearly ninety degree turn as it curves downwardly through the inner periphery or vertical bore 64 of the inner housing or wall 60. The vacuum hose 18 extending through the swivel apparatus 30 is best shown in FIG. 1.

The notches 54 and 80 are connected by three walls, a pair of side walls 82 and 84 and a bottom wall 86. The three walls 82, 84, and 86 are shown in FIG. 3, in a broken away portion of the inner housing 60. The three walls connecting the notches 54 and 80 comprise a conduit for the vacuum hose 18 through the housing 31 to the bore 64.

The inner diameter of the bore or inner periphery 64 is sufficient to allow for the bending or curving of the hose 18, without restrictions, etc. The hose 18 is, of course, relatively flexible. The hose 18, outwardly from the swivel apparatus 30, and accordingly remote from the housing 10 on the bottom 4 of the pool 2, is disposed on the surface 8 of the water 6. That is, the hose 18 floats outwardly or away from the swivel apparatus 30. It is accordingly preferable that the density of the material out of which the hose 18 is made be less than one (unity) to enable the hose to float. In the alternative, appropriate float elements (not shown) may be secured to the hose 18 to allow it to float at the top 8 of the water 6.

The flotation cap or ring 100 includes an outer periphery or outer peripheral surface 102 which has substantially the same outer diameter as the inner diameter of the inner periphery 36 of the cylindrical housing or outer wall 32. As best shown in FIG. 3, the flotation cap 100 is disposed on the shoulder 38 and also on the top of the inner wall 60. The cap 100 also includes a cutout portion 106 which coincides with the notches 54 and 80, and the walls associated therwith. The cutout portion 106 allows the hose 118 to extend through the apparatus 30 rather freely, so that a bump or movement of the hose 18 will not result in a problem with the swivel apparatus 30. Essentially, then, the apparatus 30 is independent of the hose 18 for operational or functional purposes. Obviously, however, there is a "symbiotic" or synergistic relationship between them.

The density of the material out of which the cap or ring 100 is made is also less than one (or unity) in order to provide buoyancy or flotation for the housing 31 and the swivel ring or plate 110.

A plurality of support arms 56 extend between the inner periphery 40 of the outer cylindrical wall or housing 32 and the outer periphery 62 of the inner cylindrical wall or housing 60. The arms 56 are disposed at the top of the inner wall 60 and adjacent to the shoulder 38 so as to provide additional bearing surface for the cap 100. The arms 56 comprise the structural elements which connect the outer housing 32 with the inner housing 60, along with the walls 82, 84, and 86.

The bottom swivel plate or ring 110 includes an outer periphery 112 and an inner periphery 114. The ring 110 also includes a top surface 116 and a bottom surface 118. The top surface 116 of the ring 110 bears against the rims 44 and 68 of the flanges 42 and 66, respectively. The bottom surface 118 bears against the rims 48 and 72 of the flanges 46 and 70, respectively. The ring 110 is accordingly disposed on, and supported by, the rims and flanges at the lower portion of the outer housing 32 and the inner housing 60.

Extending downwardly from the bottom surface 118 of the ring 110 is a nozzle 120. The nozzle 120 allows water to flow from the chamber 90 outwardly. In FIG. 1, the water supply hose 132 is shown extending between the nozzle 120 of the ring 110 and the cleaning head apparatus 130.

The water nozzle 120 includes a bore 122 through which the water flows from the chamber 90 to the hose 132. The bore 122 accordingly communicates with the chamber 90.

The ring 110 is movable relative to the concentric cylindrical housings 32 and 60, and accordingly moves about the inner housing 60, and about the vertical bore 64 of the inner cylinder 60. The ring 110 therefore moves or swivels about the vacuum hose 18, as best shown in FIG. 1, while the hose 18 extends downwardly through the bore 64.

The design of the floating cleaning apparatus head 130 allows it to move beneath the hose 18, outwardly from the swivel apparatus 30, as the hose 18 is floating on the top 8 of the water 6. This is shown in phantom in FIG. 1. Since the cleaning head 130 is secured to the swivel apparatus 30 by the hose 132, as the cleaning head 130 moves randomly in the water, propelled by the water from the whip or hose 134, the ring 110 rotates or moves or swivels relative to the housings 32 and 60. The water supply hose 132, secured to the nozzle 120 and extending to the cleaning head 130, does not become entangled with the vacuum hose 18 extending between the swivel apparatus 30 and the water inlet vacuum housing 10. Rather, the cleaning head 130 and the hose 132 simply move around the hose 18 and beneath the floating portion of the hose 18. The cleaning head 130 similarly moves beneath the floating hose 20 which supplies water to the chamber 90 through the nozzle 52.

Water for the hose 132, as discussed above, flows into the chamber 90 through the nozzle 52 from the hose 20, and from the chamber 90 through the bore 122 of the nozzle 120 to the hose 132. In order to allow the ring or plate 110 to move or swivel rather freely relative to the cylindrical housings 32 and 60, the contact between the upper and lower surfaces 116 and 118 of the ring 110 and the rims 44, 48, 68, and 72 is not an extremely tight fit, but neither is it a loose or sloppy fit.

The contact between the ring 110 and the respective rims 44, 48, 68, 72 provides some semblance of a seal which allows water flowing into the chamber 90 through the nozzle 52 to flow outwardly through the nozzle 120 and through the hose 122. However, it will be obvious that there is some water outflow from the chamber 90 through the ring 110 and the rims 44, 48, 68, and 72. Such outflow is, however, relatively minimal and does not adversely affect the cleaning effect of the head 130 and its whip or hose 134 with respect to stirring up the water and any debris in the water so as to aid in the flow of the water into the vacuum housing 10 and out through the vacuum hose 18 so that the water is adequately filtered.

It is obvious that there must be direct contact between the respective rims and the ring 110 for support and for seal purposes. However, it is also apparent that the contact should be as minimal as possible so as not to preclude the relatively free movement of the ring 110 with respect to the cylinders 32 and 60.

As is understood, the movement of the cleaning head 130 through the water 6 is random and is based on the random movement of the whip 134. Water flowing from the free end of the whip 134 causes the random movement of the cleaning head 130. The hose 132, extending between the cleaning head 130 and the apparatus 30, supplies water to the cleaning head 130 and its whip 134 from the chamber 90. Movement of the cleaning head 130 in turn results in movement of the hose 132.

The hose 132 is connected to the ring or plate 110, and movement of the hose 132 results in movement of the ring or plate 110. Since the movement of the cleaning head 130 and its whip 134 is random, the movement of the hose 132 and the ring 110 is also random. Hence the "swiveling" of the ring 110. That is, the ring 110 does not "rotate" in a definite or predetermined pattern. Rather, it swivels back and forth randomly in response to movement of the cleaning head 130 and the whip 134 and the hose 132. It thus appears that the term which best describes the movement of the ring 110 is "swivel". The ring 110 is, of course, capable of regular rotational movement, and the swiveling motions or movements are in fact rotational movements.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Cleaning apparatus for an above-ground swimming pool having a pool bottom and water in the pool, comprising, in combination:

water inlet housing means adapted to be disposed on the pool bottom;

a water vacuum hose connected to the water inlet housing means and extending upwardly to the top of the water in the pool;

cleaning head means floating on the top of the water in the pool and movable randomly in the pool; and swivel means at the top of the water in the pool, including housing means disposed about the water vacuum hose, first connection means for connecting the housing means to a first water supply hose, a ring movable in the housing means relative to the housing means and to the water vacuum hose, and second connection means on the ring for connecting a second water supply hose to the cleaning head means for supplying water to the cleaning head means.

2. The apparatus of claim 1 which the swivel means further includes a flotation cap secured to the housing means for providing buoyancy for floating the swivel means.

3. The apparatus of claim 1 in which the housing means includes an outer housing, an inner housing spaced apart from the outer housing, and the ring is disposed between the inner and outer housings.

4. The apparatus of claim 3 in which the housing means further includes a central bore adapted to receive the water vacuum hose.

5. The apparatus of claim 4 in which the swivel means further includes a flotation cap secured to the inner and outer housings.

6. The apparatus of claim 1 in which the water inlet housing means includes a housing and a screened inlet through which water flows into the housing and to the water vacuum hose.

* * * * *